United States Patent [19]

Hunter

[11] Patent Number: 4,660,677

[45] Date of Patent: Apr. 28, 1987

[54] PERSONNEL EVACUATION APPARATUS FOR AN OFFSHORE PLATFORM

[75] Inventor: Andrew F. Hunter, Houston, Tex.

[73] Assignee: Conoco Inc., Ponca City, Okla.

[21] Appl. No.: 891,510

[22] Filed: Jul. 28, 1986

[51] Int. Cl.[4] ..... A62B 37/00; A62B 1/20

[52] U.S. Cl. ..... 182/10; 182/39; 114/366; 114/375

[58] Field of Search ..... 182/10, 191, 11, 39; 114/366, 375, 367, 344

[56] References Cited

U.S. PATENT DOCUMENTS

| | | | |
|---|---|---|---|
| 1,069,905 | 8/1913 | Scott | 114/366 |
| 1,101,475 | 6/1914 | Sprague | 114/366 |
| 1,103,971 | 7/1914 | Kratky | 114/366 |
| 1,130,569 | 3/1915 | Cocking | 114/366 |
| 1,270,903 | 7/1918 | Wiesmantel | 114/375 |
| 1,282,323 | 10/1918 | Trinkle | 182/10 |
| 1,556,555 | 10/1925 | Brown | 182/11 |
| 3,796,281 | 3/1974 | Dowling | 812/191 |
| 3,826,335 | 7/1974 | Allen | 182/191 |
| 3,880,254 | 4/1975 | Fitzgerald et al. | 182/10 |
| 4,203,504 | 5/1980 | Reynoir et al. | 182/10 |
| 4,286,346 | 9/1981 | Wiek | 114/344 |
| 4,341,286 | 7/1982 | Gregory | 182/10 |
| 4,359,900 | 11/1982 | Lyles | 114/230 |

OTHER PUBLICATIONS

Watercraft America Inc. product brochure.

"Survival Capsule Designed to Withstand Offshore Fire", *Oil and Gas Journal,* p. 164, Dec. 6, 1982.

*Primary Examiner*—Reinaldo P. Machado

*Attorney, Agent, or Firm*—Richard K. Thomson

[57] ABSTRACT

Personnel evacuation apparatus for use with an offshore platform. A launching ramp that is mounted to the platform by a gimbal is stowed in a vertical position with a survival vessel secured in the entry end of the ramp. A release mechanism activatable from the deck of the platform enables flotation members secured to the exit end of the ramp, to pivot the ramp about the gimbal to its deployed position. The gimbal further permits the ramp to maintain a usable orientation in spite of inclination of the deck of the platform by 25° due to pitch, roll or yaw. The exit end will pivot under wave action so as to gravity launch the survival vessel downwind and, upon release of the boat securement, carry the vessel safely away from the platform.

13 Claims, 3 Drawing Figures

PERSONNEL EVACUATION APPARATUS FOR AN OFFSHORE PLATFORM

BACKGROUND AND SUMMARY OF THE PRESENT INVENTION

The present invention relates to an apparatus for evacuating personnel from an offshore platform. More particularly, this invention relates to a stowable launching ramp that is gimballed to the downward side of the platform and a survival craft launchable therefrom to get personnel away from the platform in all weather conditions.

Conventional personnel evacuation equipment for offshore platforms has been adapted from ships and generally comprises some form of life boat that can be lowered to the surface of the water using a davit or similar crane mechanism. Many systems currently in use have not changed appreciable in 75 years. Such devices may be suitable for usage in "duck pond" conditions where a fire, or the like, is the reason evacuation is necessary. However, in a severe storm that threatens the stability of the platform and, accordingly, the lives of all personnel manning the platform, to leave the platform in such a craft is not unlike jumping from the frying pan into the fire. Conventional life boats will capsize in a matter of minutes in such a storm. Even self-righting survival vessels are in jeopardy of being smashed to pieces by wave action against the below-deck portions of the platform or subject to being blown off the supports by high winds or snapping of the cables due to excessive loading during lowering to the surface of the ocean. A safer means of evacuating personnel to an acceptable distance from the platform is required.

The present invention provides such a system. A self-righting survival vessel is maintained in a launching ramp by releasable securing means. The launching ramp is stored in a substantially vertical position by engagement of a catch on the exit end of said ramp with latch means on the sub-sea portion of the platform that can be released from the deck of the platform. Once released, the exit end of the launching ramp is moved to its deployed position by flotation means. The launching ramp is mounted on a deck of the platform by a universally gimballed connection which permits the exit end of the ramp to pivot to a downwind position and to accommodate the movement of the waves vis a vis the deck of the platform as well as permitting the pitch, roll and yaw of the deck itself (at least 25° from vertical in any direction).

The lateral pivoting of the ramp is limited at ±50° from perpendicular relative to the edge of the platform upon which the evacuation system is mounted so that the survival vessel cannot be discharged too near to the platform thereby jeopardizing the vessel's occupants. Once the launching ramp is deployed, the survival vessel can be manned and the release mechanism disengaged so as to release the vessel. The vessel will be gravity-launched onto the ocean so that the momentum of the craft will carry it away from the platform. Further, prevailing winds will ordinarily carry the vessel away from the platform since the launching ramp is preferably gimballed to the downward side of the platform. There are preferably at least two parallel launching ramps making possible simultaneous multiple craft deployment.

Other features, characteristics and advantages of th present invention will become apparent after a readin of the following detailed description.

DETAILED DESCRIPTION OF THE PREFERRED EMBODIMENTS

Figure 1:
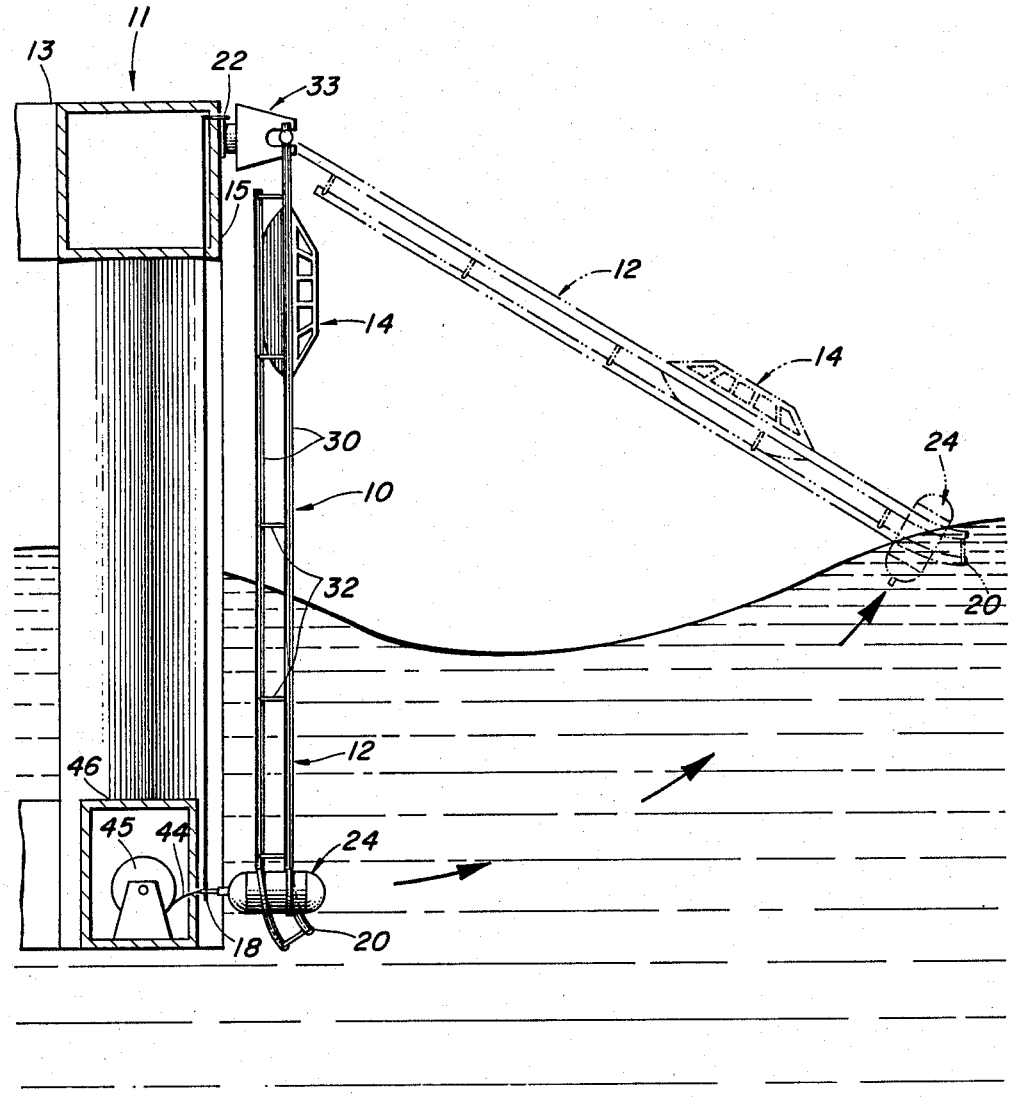
FIG. 1 is a schematic side elevation of the personne evacuation system of the present invention shown in th stowed position in solid lines and in the deployed posi tion in dotted lines.

The personnel evacuation apparatus of the presen invention is shown in FIG. 1 generally at 10 attached t platform 11 in the vicinity of deck 13. Although th platform 11 shown in the figures is a semi-submersible it will be appreciated that the evacuation system of th present invention can be utilized with any known typ of platform.

Figure 2:
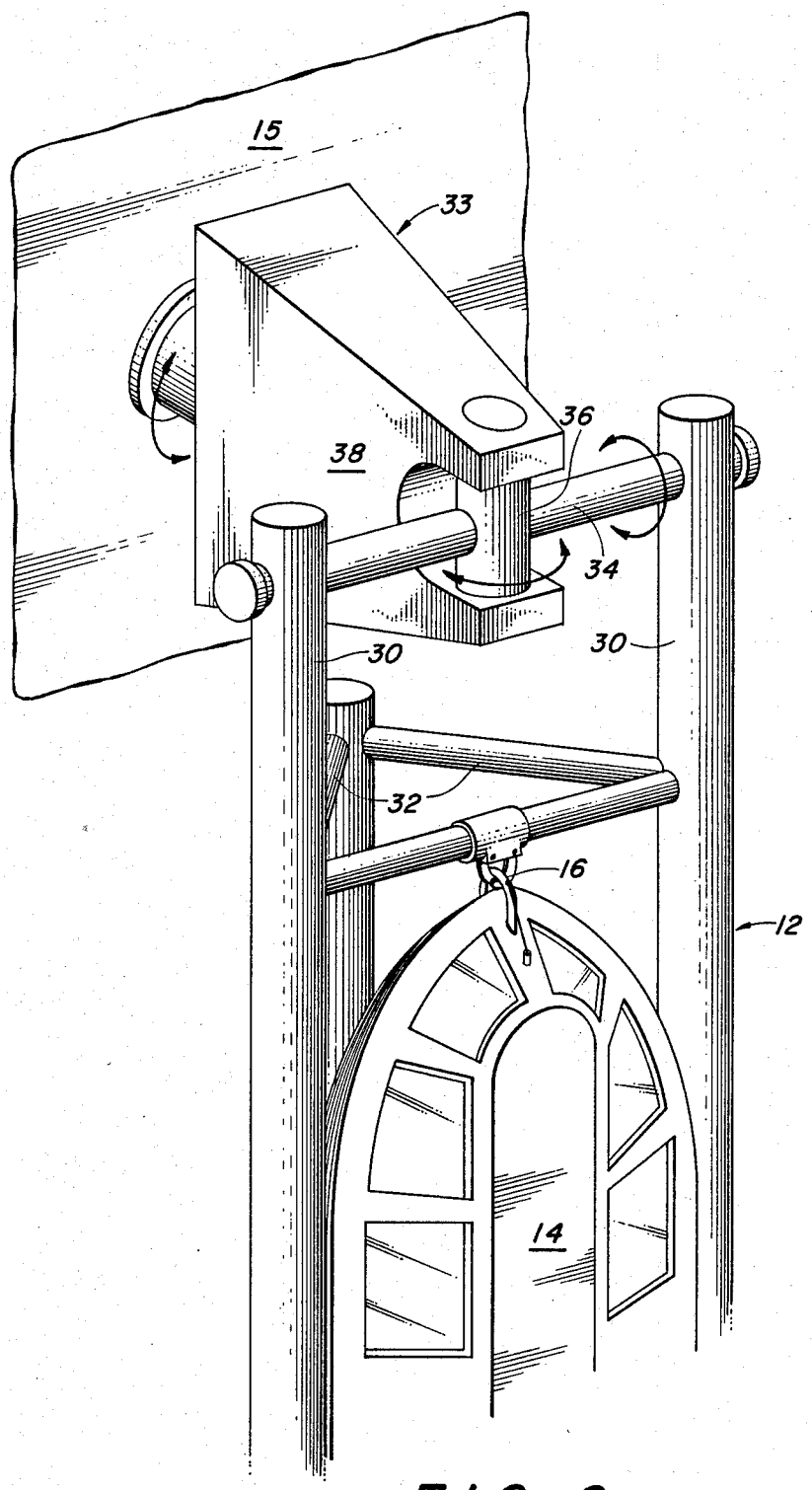
FIG. 2 is a detailed isometric view of the upper por tion of a single ramp design of the evacuation system o the present invention.

Evacuation apparatus 10 comprises a launching ram 12 and a boat means 14. The boat means 14 is preferabl any self-righting, fully enclosed, fire resistant surviva vessel capable of safely accomodating between twent and sixty people (depending on boat length) and may b a survival vessel of the type that is manufactured an marketed by Watercraft America Inc., from Edgewa ter, Fla. The hull may need to be reinforced and th power outdrive redesigned to permit the craft to slid down ramp 12. Survival vessel 14 is mounted in sai launching ramp 12 by releasable securing means 1 (FIG. 2). Securing means 16 is preferably releasabl from inside craft 14. The actuator for said release ma be electrically, pneumatically or hydraulically oper ated, but most preferably has a redundant backup re lease that is entirely mechanically operated in case th primary system fails.

Evacuation apparatus 10 is pivotally mounted to th normally downwind side of the platform 11 in orde that the survival vessels 14 may be deployed downwin and carried by the wind and waves away from the plat form 11, rather than being tossed against the subse portions of the columns. Since there is very little that i "normal" about a hurricane, in zones subject to suc storms, redundant systems mounted on opposite sides o the platform should be considered. Such an evacuatio system will ensure that the vessels 14 can be safel deployed with no worse than a quartering tail win which will carry them away from the platform 11.

Launching ramp 12 is maintained in a generally verti cal stowed or standby position as seen in solid line i FIG. 1 by latching means 18 engaging exit end 20 o ramp 12. Latching means 18 is operable from deck 13 b mechanism 22 to release exit end 20 of ramp 12. Mecha nism 22 may, again, be electrically, pneumatically o hydraulically operated but preferably has a redundan mechanical system as backup. In this manner a powe outage caused by a fire or storm that might disable pump, compressor, servo-mechanism, or the like, can not prevent deployment of the evacuation system 10.

Mounted near exit end 20 of ramp 12 is flotatio means 24. Flotation means 24 preferably comprises pair of buoyant flotation members 26 and 28. Thes flotation members 26 and 28 may be permanently buoyant (i.e., filled with polystyrene foam) or, more preferably, capable of being ballasted with sea water for ease in positioning the ramp in its stowed location and deballasted to facilitate movement to the deployed position (dotted line, FIG. 1). If, for example, deck 13 is nominally forty feet above sea level, ramp 12 might be eighty feet long (half submerged in the stowed position). The launch ramp 12 would then form an angle of about 30° with the surface of the ocean when deployed. In the deployed position, the center of buoyancy for flotation members 26 and 28 is above the center of gravity for the end of ramp 12 for reasons set forth here below.

As best seen in FIG. 2, ramp 12 comprises three parallel support tubes 30 interconnected by latticework supports 32. The arrangement of supports 32 is exemplary; the actual configuration would be a function of design considerations. Tubes 30 are preferably sections of steel pipe with closed ends. The hollow tubes 30 will add to the buoyancy of the launching ramp reducing the effective weight hanging on the mounting 33. Mounting 33 comprises a universally gimballed support. A first bar 34 is rotatably received through a second bar 36. The diameter of bar 34 is reduced at the point of transiting bar 36 and the shoulders formed thereby prevent lateral sliding of bar 34 relative to bar 36. The ends of bar 34 are fixedly received in the ends of tube 30. The ends of second bar 36 are rotatably received in C-bracket 38 the base of which is itself rotatably mounted on the side face 15 of deck 13. Bearings (not shown) facilitate movement of all rotatable parts.

The length of bar 34 and its distance from side 15 are such that the rotation about the axis of second bar 36 is limited to 50° in each lateral direction (i.e., the ends of bar 34 contact side 15) in order to prevent the exit end of launching ramp 12 from discharging a vessel 14 too near to the platform 11. Obviously, if such special relationships between the lengths of bar 34 and C-bracket 38 did not exist, a stop bar or plate (not shown) could be installed to limit rotational motion to the desired ±50°. Further, the gimballed connection depicted here is only exemplary of the mounting that could be employed. A ball and socket connection could work equally as well provided that the rotational axis of the ball could be moved to and locked in a first horizontal position corresponding to the stowed position for ramp 12 and a second position that could be either vertical or inclined 30° from vertical (toward ramp 12) corresponding to the deployed position of ramp 12.

Figure 3:
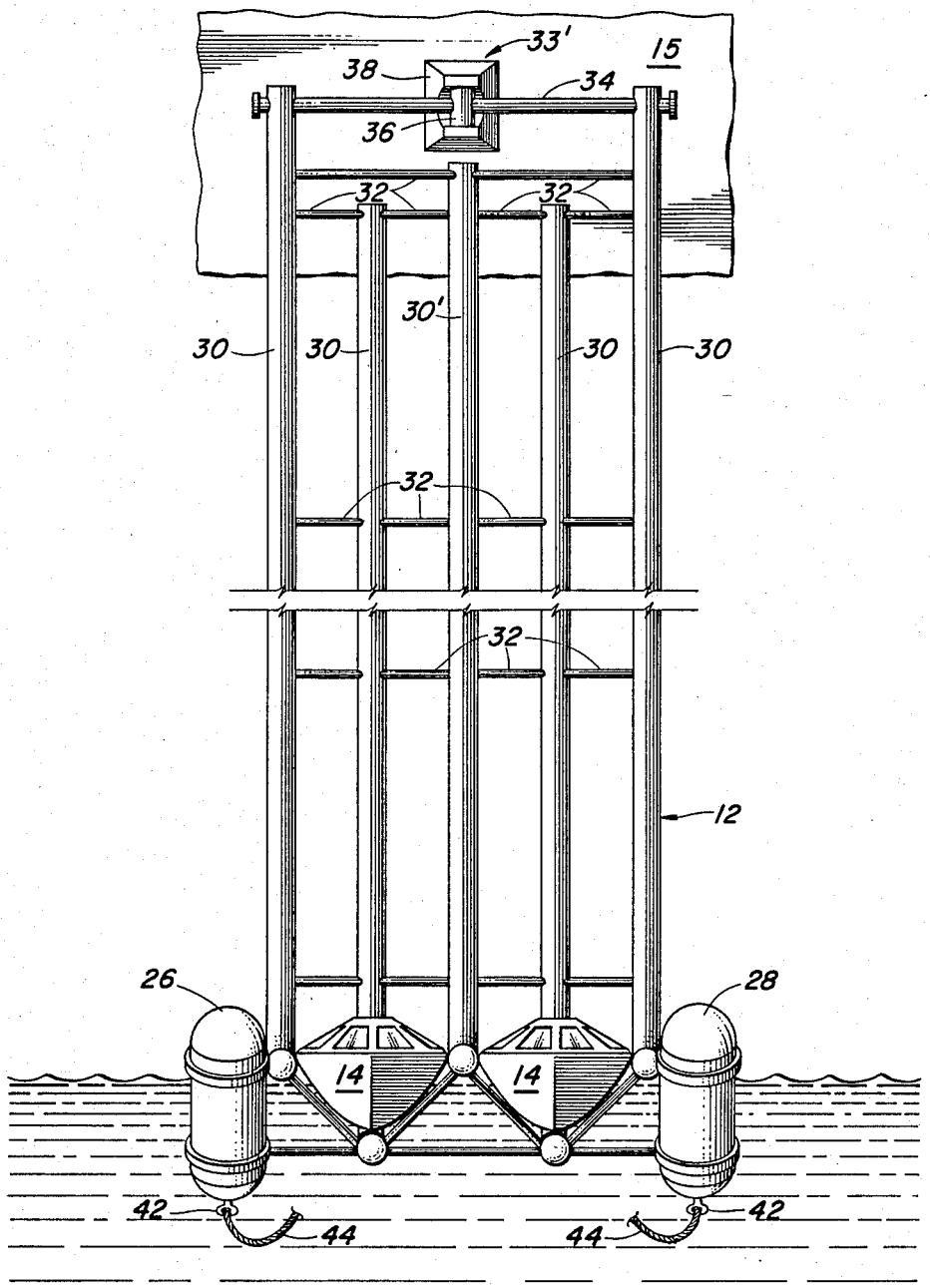
FIG. 3 is a schematic end view of the personnel evac uation system of the present invention showing a doubl ramp configuration.

Rather than reloading a ramp 12 with a second and/or subsequent survival vessel, it is preferred that there be as many ramps as necessary to evacuate all personnel manning the platform simultaneously. Should the stability of a structure be threatened by a storm, time will be of the essence and an evacuation system requiring reloading of a second vessel into a ramp may result in loss of lives. Obviously, a plurality of single ramps of the type depicted in FIG. 2 could be employed or, as depicted in FIG. 3, a double lane ramp 12 which shares a single center tube 30' might be mounted by a single gimbal mount 33'. It is preferred that exit end 20 of ramp 12 be slightly curved upwardly to facilitate a smoother transition onto the ocean's surface.

In operation, the survival vessel is secured by releasable means 16 in ramp 12 which is similarly held in a stowed position (FIG. 1, solid line) by latch means 18. Note, the cable for releasing latching means 18 may be entirely housed within the structure of the platform for protection. When it is desired to utilize the personnel evacuation system 10, latch disengaging mechanism 22 is utilized on deck 13 to release the exit end of ramp 12. Since the center of buoyancy is outboard of the center of gravity, a force tending to produce movement about the center of gravity will be induced, said moment tending to move ramp 12 to its deployed position (FIG. 1, dotted line). Gimballed connection 33 will permit the exit end of ramp 12 to be moved to a downwind position by wind and waves and to accomodate for at least 25° tilting of the deck of the platform in any direction. If the stability of the platform is sufficiently jeopardized to warrant abandoning it, the personnel evacuation system must be capable of functioning in such high tilt angles to be truly useful. Survival vessel 14 can be loaded to its maximum safe capacity by means of a cat walk or extensible ladder (not shown), and securing means 16 released to launch the vessel.

Survival vessel 16 will slide down ramp 12 (which forms about a 30° angle with the surface of the ocean), be leveled out slightly by the upturned end 20 of ramp 12 and be discharged onto the surface of the ocean a safe distance from the platform 11. The momentum of the vessel 14 will tend to carry it away from the platform. Further, since the ramp 12 has pivoted to discharge the vessel 14 downwind (or at worst, with a quartering tail wind), the action of the wind and waves will tend to carry the survival craft 14 further from platform 11.

Eyelets 42 on the bottom of flotation members 26 and 28 enable engagement by retrieval cables 44. Once cables 44 are connected (as shown in FIG. 3), ramp 12 can be returned to its stowed position by activating the windup drums 45 (one shown) which are housed inside protective covering 46. As noted, it is preferred that the flotation members 26 and 28 be ballasted with sea water to facilitate return of ramp 12 to the stowed position. All surfaces exposed to salt water including the retrieval cables 44 and the inner surfaces of flotation members 26 and 28, are coated with a bio-fouling resistant coating to preserve optimum operability. Once retrieval has been accomplished, eyelets 42 are disengaged by cables 44 and re-engaged by latching means 18. In the alternative, latching means 18 may be connected to cables 44 and perform a dual function of latching and connecting cable 44 for retrieval. Retrieval of the ramp would be important to locate the ramp in the stowed position (1) upon initial installation, (2) upon abatement of the storm (absent a catastrophic failure of the platform), and (3) following a drill to practice evacuation safety procedures.

Various changes, modifications and alternatives will become apparent to one of ordinary skill in the art following a reading of the foregoing specification. It is intended that all such changes, modifications and alternatives as come within the scope of following claims be considered part of the present invention.

I claim:

1. Apparatus for evacuating personnel from an offshore platform in all weather conditions to a position on the ocean surface a safe distance from said platform said apparatus comprising:

a boat launching ramp having an entry end pivotally attached to said platform in the general vicinity of a deck thereof;

flotation means secured to an opposite exit end of said ramp;

latching means to secure said exit end of said ramp in a stowed position wherein said ramp is disposed generally vertically and said flotation means is located beneath the surface of the ocean;

boat means adapted to be supported and launched by said ramp;

means for releasably securing said boat means within said ramp means adjacent said entry end;

means for releasing said latch means to permit said flotation means to move said launching ramp from its stowed position to a deployed position;

means for releasing said boat securing means, thereby permitting said boat means to slide down said ramp and be launched from the exit end of said ramp onto the surface of the ocean a safe distance from said platform.

2. The personnel evacuating apparatus of claim 1 wherein said boat launching ramp is pivotally attached to said platform by means permitting said ramp to sweep laterally a maximum of 50° in each direction in a horizontal plane from a position in which said ramp projects perpendicularly from a side of said platform.

3. The personnel evacuation apparatus of claim 2 wherein said pivot means comprises a universally gimballed connection with lateral limits at said 50° lateral sweep to prevent said ramp from discharging said boat means too near to said platform.

4. The personnel evacuation apparatus of claim 3 wherein said universally gimballed connection permits at least a 25° tilting in any direction to accomodate a like amount of pitch, roll and yaw of said platform relative to a vertical direction.

5. The personnel evacuation apparatus of claim wherein the exit end of said ramp is responsive to wav action using said entry end to swing upon said pivot: attachment to discharge said boat means generall downwind.

6. The personnel evacuation apparatus of claim wherein the exit end of said ramp is slightly curve upwardly to facilitate discharge of said boat means ont the ocean surface.

7. The personnel evacuation apparatus of claim wherein said boat means comprises a self-righting su vival craft.

8. The personnel evacuation apparatus of claim wherein said flotation means comprises at least tw buoyant flotation members.

9. The personnel evacuation apparatus of claim wherein said flotation members can be ballasted fc positioning said ramp in the stowed position.

10. The personnel evacuation apparatus of claim further comprising cable means connectable to the ex end of said launch ramp to enable said launch ramp t be returned to said stowed position.

11. The personnel evacuation apparatus of claim wherein said ramp means comprises at least three para lel support tubes.

12. The personnel evacuation apparatus of claim 1 wherein said parallel support tubes are positioned to a engage a lower hull surface of said boat means.

13. The personnel evacuation apparatus of claim wherein said ramp means comprises two adjacen launching ramps permitting independent loading an launching of a pair of boat means without requirin reloading of said ramp means.

* * * * *